United States Patent [19]

Taylor

[11] Patent Number: 4,668,185

[45] Date of Patent: May 26, 1987

[54] PROCESS AND APPARATUS FOR DRYING ORGANIC MATERIAL IN A ROTARY DRYER

[75] Inventor: Andrew W. Taylor, Mount Maunganui, New Zealand

[73] Assignee: Pacific Proteins Limited, Mount Maunganui, New Zealand

[21] Appl. No.: 787,925

[22] Filed: Oct. 16, 1985

[30] Foreign Application Priority Data

Oct. 16, 1984 [NZ] New Zealand ..... 209889

[51] Int. Cl.[4] ..... F27B 7/34

[52] U.S. Cl. ..... 432/105; 432/106; 432/110; 432/136

[58] Field of Search ..... 432/105, 106, 108, 110, 432/118, 33, 135, 136, 141, 18

[56] References Cited

U.S. PATENT DOCUMENTS

| | | | |
|---|---|---|---|
| 3,155,380 | 11/1964 | Lessard | 432/110 |
| 3,950,861 | 4/1976 | Weimer et al. | 432/118 |
| 4,339,883 | 7/1982 | Waldmann | 34/77 |
| 4,464,111 | 8/1984 | Rastogi et al. | 432/106 |
| 4,504,222 | 3/1985 | Christian | 34/182 |
| 4,573,278 | 3/1986 | Ruiz-Avila | 34/171 |

FOREIGN PATENT DOCUMENTS

| | | | |
|---|---|---|---|
| 46896 | 1/1919 | Norway | 432/110 |

OTHER PUBLICATIONS

Brochure entitled, "Flo-Dry Rotary Dryer", 11/1985.

Brochure entitled, "Marinz Continuous Low Temperature Rendering System", 8/1984.

"Gas Drier—A First", published in Food Processing News—Meat, Oct. 1986, p. 11.

*Primary Examiner*—Larry I. Schwartz

*Attorney, Agent, or Firm*—Oblon, Fisher, Spivak, McClelland & Maier

[57] ABSTRACT

A rotating drying chamber has a hot zone 6 and a cooler zone 10. The temperature in the hot zone 6 is high, whereas the temperature in the cooler zone 10 is lower. The material to be dried is held in the hot zone 6 for a shorter period of time than it is held in the cooler zone 10. The dried product is recovered through a discharge valve 17.

16 Claims, 4 Drawing Figures

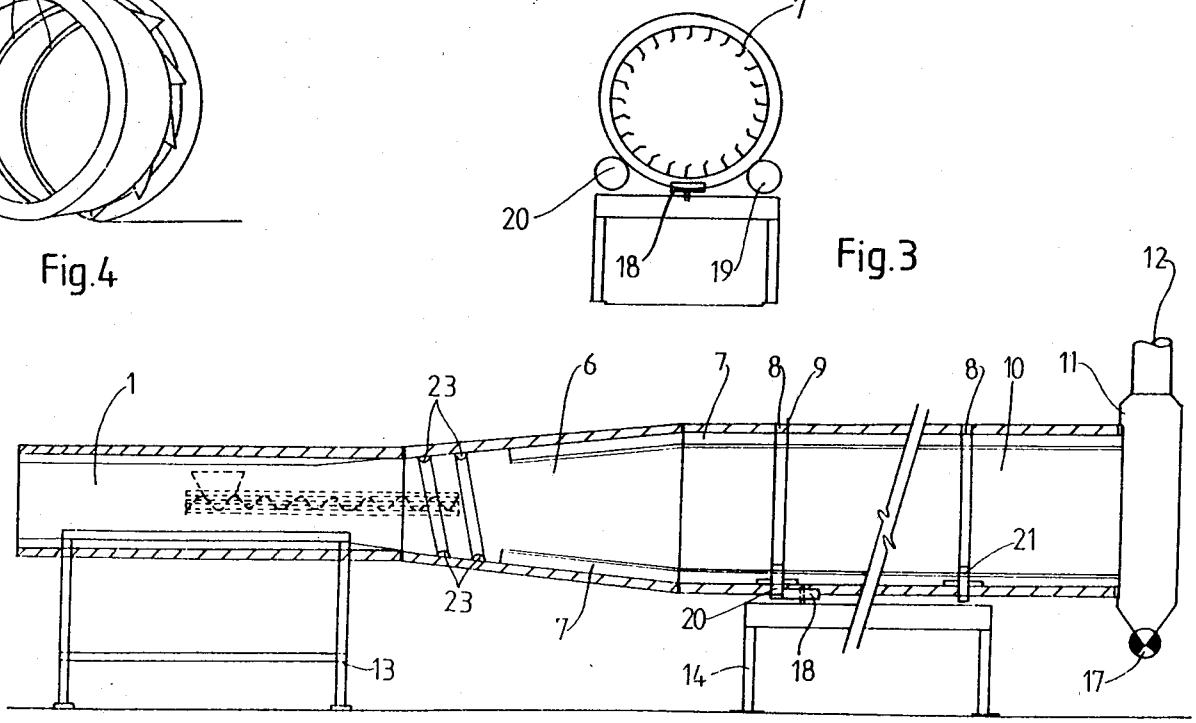
Fig.2
Fig.3
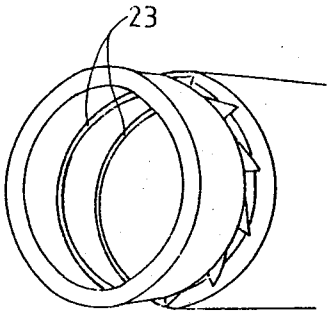
Fig.4

PROCESS AND APPARATUS FOR DRYING ORGANIC MATERIAL IN A ROTARY DRYER

FIELD OF THE INVENTION

This invention relates to drying means for drying damp material to obtain a product with a predetermined moisture content.

BACKGROUND OF THE INVENTION

From a meat rendering plant three products are produced, tallow, meal and waste water. The meal will comprise a high proportion of protein and bone, if bone is processed at the same time. This meal has a market as an animal feed the price of which depends on the degree of available protein in the meal. When drying the meal after removal of the tallow and the majority of the waste water, there are two or optionally three requirements. The first requirement is to remove as much water as is required; generally to less than 8%. The second requirement is to avoid denaturing the protein. The third optional requirement is to sterilise the meal when that is necessary. Balancing all three factors together has resulted in drying by indirectly heating through jacketed steam vessels. Temperatures in the vessel in the range of 110°–135° C. are the normal temperatures employed, with residence times of 2–3 hours being used. At these temperatures there is still some denaturing of the protein because of the long residence time. By drying at such temperatures, it is not possible to remove wool or other hair residues. Such may be present in small amounts but such small amounts can lead to a much lower grading for the product and hence a lower price. Sterilisation can be achieved by other means than in the drying step.

Rotary driers have been used heated by combustion of a suitable fuel. Because of fires which have commonly developed, such driers have not proven to be commercially successful for drying organic materials.

The reason for such fires is considered by the current applicant to be that the rate of flow of the material passing through the naked flame was not adequately controlled.

There are other materials where a product needs to be dried to a predetermined moisture content. A number of standards for various materials require drying to achieve a moisture content of 8% or less. At this level of moisture, most products are stable for long term storage. The problems of drying to a predetermined moisture level are the difficulty in establishing precisely when that moisture level has been reached. Thus overdrying is normally undertaken to ensure compliance with the standard. This results in increased fuel cost and increased damage to the product. Other products where moisture content may vary are blood from meat processing works, grain, sewage sludge and the like. The majority of these materials are of organic origin, and it is drying of these materials which is the main purpose of the current invention. It is however envisaged that the process and the apparatus of the invention can be used to dry other materials.

GENERAL DESCRIPTION OF THE INVENTION

This invention provides a process in which the damp feedstock is subject to controlled temperature drying as it passes through a first very hot zone and then through a zone of decreasing temperature.

Further in accordance with this invention there is provided an apparatus for drying damp material comprising a rotatable inlet chamber adapted to be heated to a high temperature by a heat source and adapted such that feedstock entering said chamber is resident therein for a short period, a second rotatable chamber adapted to be heated to a temperature lower than the first and adapted such that feestock is resident therein for a longer period, and an outlet end adapted for recovering dried material having a predetermined moisture content.

In accordance with a further aspect of the invention there is provided a method of drying and sterilising damp proteinaceous material, comprising subjecting such material to a high temperature for a short period of time, then subjecting the material to a lower temperature for a longer period of time and recovering the dried product.

In the method of the invention the initial high temperature zone is designed to be as hot as possible to flash evaporate surface moisture and also to flashburn any fine hair residues that may be present, but insufficiently high as to cause significant denaturing of the protein or damage to other organic material that may be present. The residence time in this zone is short, such time being dependent upon the particular temperatures employed to ensure the above criteria are met. The temperature needs to be at least about 750° C. but desirably less than 900° C., with the residence time being a few seconds. The heating is desirably by direct heat transfer from a live flame for greatest energy conversion, the heat being transferred by natural convection and radiation desirably assisted such as by a compressed air blower driving air through the live flame of the burner to create the hot zone. It is important in accordance with this invention to minimise contact of the proteinaceous material with the live flame as control over the degree of denaturisation is difficult—which can even lead to the feedstock starting to burn. Preferably there is no contact. The feedstock moves from the hot zone into a lower temperature zone which can be a continuation of the hot zone but more remote from the combustion chamber. In this zone, the temperature gradient can be relatively uniform from close to that of the hot zone down to a temperature at the outlet end desirably above 100° C. A temperature below 100° is undesirable as it is difficult to sufficiently dry the product below that temperature. The residence time in the lower temperature zone can vary from a few minutes up to an hour or even more. For reasons of economy, it is desired to keep the residence time as short as possible whilst still obtaining a dried product.

In accordance with this invention it has been found that, by the controls referred to above, it is possible to use a rotary drying cylinder to dry the feedstock. The drier will have suitable means for feeding in the wet feedstock—desirably in a continuous manner, such as from the outlet of the meat processing plant.

This invention is principally envisaged to be of use in drying damp bonemeal in a meat processing plant and will hereinafter be described with reference to that method.

Because the characteristics of the product from the outlet of the meat processing plant as well as the flow rate thereof can vary considerably dependent on the nature of the material being processed and speed of operation, it is an important feature of this invention to provide a method of continuously monitoring the temperature of the drier and automatically adjusting the heating means to ensure that the temperature of the hot zone and the outlet is at a satisfactory level. One method currently envisaged is to have a temperature sensor at the outlet designed to generate a signal whenever the temperature varies from 110° by a desired temperature differential such as 5°, more specifically 2°. The generated signal is designed to automatically increase or decrease the output of the heating source to thus raise or lower the temperature within the drier. It is considered feasible by such adjustment techniques to ensure that the inlet zone temperature is above the desired minimum temperature, which will generally be 750° C. It is envisaged within the invention for a temperature sensor to be placed within the hot zone. Such a temperature sensor would be designed to generate a signal to be read in conjunction with the signal from the sensor in the outlet. A "hot zone" sensor can be designed to maintain the temperature within the hot zone in the range of 750° to 900° C.

The signals from the hot zone sensor and the outlet sensor can be compared and variation to the output of the heating source and/or rotation speed of the dryer altered to achieve the desired outlet temperatures.

The drier desirably agitates the feedstock (e.g., by inwardly protruding baffles) so that the feedstock is suspended within the cylinder for much of its length. This improves the drying speed.

The temperature gradient can be achieved by making the drying system one continuous chamber, with the hot zone at the front leading into the lower temperature zone. The temperature gradient can be achieved by forcing air through the flame in the combustion chamber. By suitable choice of the speed of the air and length of the various chambers, the desired temperature ranges can be achieved. In order that the residence time in the hotter zone at the front of the cylinder is short, this section of the rotating chamber will have a floor sloping at a greater angle than the remainder of the chamber. In order to assist in forward movement of the feed, forwardly directing baffles can be provided. It has been found that these baffles need not be greatly pronounced. For example, a simple helical raised rib on a cylindrical chamber floor can be effective.

It is a further important feature of the invention for exhaust gases to be recycled. In this way much of the available energy units in the fuel can be utilised. It is desirable to dehumidify at least part of the exhaust gases to reduce the build up of moisture within the drying chamber. It is also desirable to cool the dehumidified gases preferably to 30° to 60° C. to further increase the humidity uptake of this portion of the gases. By suitable choice of the proportion of the streams of recycled gases to the stream(s) of fresh gases, the maximum utilization of the heat values together with rapid continuous drying can be achieved.

BRIEF DESCRIPTION OF THE DRAWINGS

The apparatus of the invention is described by way of example with reference to the accompanying drawings in which FIG. 2 is the side elevation of the drier of FIG. 1, FIG. 3 is a cross section of the drier of FIG. 1, and FIG. 4 is a perspective view of the inlet of the drier.

DETAILED DESCRIPTION OF THE PRESENTLY PREFERRED EMBODIMENT

Figure 1:
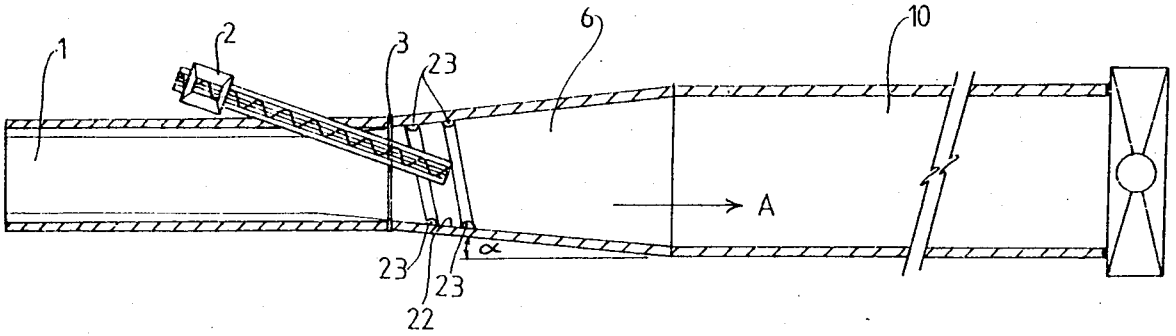
FIG. 1 is a plan schematic view of one form of drier for use in this invention.

As shown in the drawings, the drier is preferably a continuous tube having two sections, a combustion chamber 1 and a drying chamber consisting of two parts, a hot zone 6 and a cooler zone 10. The cooler zone 10 is desirably very nearly cylindrical while the hot zone 6 is desirably of a truncated conical shape. Feed material such as wet proteinaceous material from a rendering plant is fed into the hot zone 6 by screw a conveyor 2.

The feedstock can be continuously fed from the outlet of the rendering plant. Since the outside surface of the conveyor 2 is exposed to the hot zone 6, it is a desirable feature of this invention to provide insulation means about the conveyor 2 to maintain the internal surfaces of the conveyor 2 at a low temperature. One suitable and desirable method is to provide a water jacket about the conveyor, with water being continuously circulated through the jacket. The energy values in the hot effluent water can be recovered in the rendering plant or drier if desired. The benefits of a jacketed screw fed conveyor are the positive drive feed, enabling supply to continue even if some of the material should inadvertently stick to the walls of the conveyor, and enabling a wider choice of materials for the construction of the conveyor and the jacket. For example stainless steel can be used. The screw feed outlet is designed to deliver the feedstock into the central portion of the hot zone 6. It is desirable for this purpose for the conveyor 2 to enter the dryer through the side wall of the combustion chamber 1, as illustrated in FIGS. 1 and 2.

The feed material is adapted to fall within the hot zone 6 and move in the direction of arrow A within the drying cylinder. The hot zone 6 and the cooler zone 10 are, as mentioned above, desirably one continuous rotating cylinder rotated by a suitable motor (not shown), the speed of which is variable.

The residence time of the feedstock in the hot zone 6 is for a period sufficient for fine hair and wool residues to be flashed off along with much of the surface moisture but not long enough to denature the protein material to any great extent. The residence time can be varied by varying the slope of the floor of the hot zone 6 and by varying the speed of rotation of the cylinder.

The slope of the inner wall 22 in the hot zone 6 is important. If the slope is too slight, when the feedstock is being supplied at a high rate, backflow can occur towards the combustion chamber. This can lead to ignition and disastrous fires. If the slope is too steep, the benefit of the hot zone treatment can be lost. That is, inadequate flashing of hair residues and surface moisture can occur. The presently employed slope of the hot zone 6 is such that the angle $\alpha$ in FIG. 1 is about 6°. In addition, to give a positive thrust to forward movement, baffles can be provided. Such baffles need not be too prominent. For example, as shown in FIGS. 1, 2 and 3, a helical rib 23 can be provided of one or two starts.

The slope of the inner wall in the cooler zone 10 is less than that in the hot zone 6. The angle of inclination of the cooler zone 10 is slight, as the residence time in this part of the chamber is designed to be preferably from 15 to 45 minutes. An angle of less than 1° is desired, and the currently employed slope is about 0.63°.

The whole cylinder is desirably insulated as much as possible to prevent heat losses and hence conserve energy. The output from the cylinder feeds into a hopper 11 and thence through a discharge valve 17 to a work station where it can be packed off into suitable containers. Exhaust gases from the cylinder pass out through an outlet 12 where they can all, or part of them, be recycled with part being fed through dehumidifiers for return to the combustion chamber 1.

At the outlet end of the cooler zone 10, a temperature sensor is provided to measure the temperature of the exhaust gases. This temperature is designed to be 110° C.±5° C., more preferably ±2° C. If the temperature varies from this amount then a signal is generated to vary the supply of the fuel (e.g., natural gas) to the flame in the combustion chamber 1. This is designed to give a product with a moisture content of just less than 8%. If a lower moisture content is desired, then the outlet sensor will be set to detect variations from a higher temperature. For example, a sensor detecting variations from a temperature of 135° C. can yield a product with a moisture content of 1½-2%. A temperature lower than 110° C. can be used where higher moisture contents are required. When a new cylinder is commissioned, a certain amount of experimentation will be necessary to ensure that a suitable flame size in conjunction with the velocity of the air through the combustion chamber and the rotation speed of the chamber provides the desired temperature gradient from the hot zone 6 to the outlet end. Once such has been set, then monitoring the outlet end temperature should be adequate to ensure that the hot zone temperature is satisfactory. Obviously, other monitoring systems can be employed as well as the monitoring system discussed above.

As shown in FIG. 2, the internal surface of the rotating cylinder is provided with baffles 21, desirably positioned uniformly throughout the internal circumferance of the cylinder. The baffles 21 are designed to lift the feedstock continuously so that the feedstock is as much as possible falling within the cylinder. In this fashion it is exposed to the flow of heated air for the greatest time possible, which increases the drying rate. As is shown in FIG. 2, the baffles or flights 7 can around the inner circumference of the cylinder.

The cylinder is driven through a variable speed motor, desirably through a suitable reduction gear box (not shown). The cylinder is carried on suitable bearing rollers 19 and 20 (FIG. 3) and a similar pair or pairs at necessary places along the length of the cylinder. The bearing rollers are adapted to rotate on a suitable spindle and bear against suitable support rings 8 (shown in FIG. 2). In addition, an annular flange 9 located adjacent the support rings 8 engages against a thrust roller 18. The rotational speed will be chosen in combination with the other parameters. One suitable speed is 6 RPM.

The rotating cylinder is supported on a suitable support means such as a stand 14.

The combustion chamber 1 is fixed and is supported by a suitable support stand such as a stand 13. The heating is desirably by burning a suitable flammable fuel such as natural gas within the combustion chamber 1 which is open directly into the hot zone 6. However it is desired that no live flame actually contacts the feedstock. To ensure sufficient heat is transferred into the hot zone 6 and into the cooler zone 10, air is forced through the flame in the combustion chamber 1 at sufficient speed to generate the required temperature gradient throughout the apparatus. Any recycled exhaust gases are fed into the combustion chamber 1.

Since the combustion chamber 1 is fixed and the remainder of the drier is rotating, suitable seals are provided at the junction 3 of the two units. Such a seal is not fluid tight but still allows only a minimum amount of ventilation. It is desirable to maintain the cylinder at a negative pressure in comparison to atmospheric pressure so that the ventilation flow is from outside the cylinder into the cylinder. If the flow is in the reverse direction, besides the heat loss, there is a potential dust problem created which can lead to flammability problems. The negative pressure is created by a suitable extractor fan in the outlet 12. However, the negative pressure is at a minimum to avoid extraction of a signficant amount of fines, which would reduce the amount of recoverable product.

Whilst this invention has been described with reference to preferred embodiments it is not to be construed as limited thereto. Furthermore, where specific features have been referred to and known equivalents exist therefore, such equivalents are incorporated herein as if specifically set forth.

I claim:

1. An apparatus for drying damp organic material, said apparatus comprising:

(a) a combustion chamber;

(b) a drying chamber having an at least substantially horizontal axis, said drying chamber comprising a hot zone that is in direct fluid communication with said combustion chamber and that, in use, is heated to a high temperature by heat transfer from said combustion chamber and a cooler zone that is in direct fluid communication with said hot zone and that has an outlet for the recovery of dried organic material, said hot zone having a truncated conical shape the larger diameter end of which is downstream of the smaller diameter end and being relatively short, and said cooler zone being at least substantially cylindrical in shape and being relatively long, whereby, in use, the residence time of the organic material in said hot zone is relatively short and the residence time of the organic material in said cooler zone is relatively long;

(c) first means for rotating said drying chamber about its horizontal axis; and (d) second means for supplying organic material to said hot zone such that the organic material falls on the inner wall of said drying chamber in said hot zone;

whereby, in use, surface moisture and organic surface residues on the damp organic material are flashed off in said hot zone, but the organic material is not denatured in said hot zone, and the damp organic material is dried in said cooler zone.

2. Apparatus as recited in claim 1 wherein said hot zone has a cone angle of at least about 6°.

3. Apparatus as recited in claim 1 wherein said cooler zone is conical in shape but has a cone angle of less than 1°.

4. Apparatus as recited in claim 1 wherein said cooler zone has a cone angle of at least about 0.63°.

5. Apparatus as recited in claim 1 wherein baffles are formed on the inner wall of said hot zone, said baffle serving to assist forward movement of the organic material.

6. Apparatus as recited in claim 1 wherein baffles are formed on the inner wall of said cooler zone, said baffle serving to agitate the organic material.

7. Apparatus as recited in claim 1 and further comprising a temperature sensor located in the outlet of said cooler zone.

8. Apparatus as recited in claim 1 wherein said combustion chamber is fixed relative to said drying chamber.

9. Apparatus as recited in claim 1 wherein said second means comprises a screw conveyor.

10. Apparatus as recited in claim 9 wherein said screw conveyor is surrounded by an insulating jacket that, in use, contains a flowing fluid for cooling purposes.

11. Apparatus as recited in claim 1 wherein said second means extends through a sidewall of said combustion chamber and has an outlet at least approximately on the axis of said hot zone.

12. Apparatus as recited in claim 1 and futher comprising a third means for recycling the exhaust gases to recover the heat values therefrom.

13. Apparatus as recited in claim 12 and further comprising fourth means for dehumidifying the exhaust gases that are being recycled.

14. Apparatus as recited in claim 13 and further comprising fifth means for cooling the exhaust gases after passage through said fourth means.

15. Apparatus as recited in claim 1 wherein said cooler zone is cylindrical in shape and is inclined to the horizontal by less than 1°.

16. Apparatus as recited in claim 1 wherein said cooler zone is inclined to the horizontal by an angle of at least about 0.63°.

* * * * *